United States Patent [19]

Spring

[11] 4,397,218

[45] Aug. 9, 1983

[54] CUSHION STOP FOR HYDRAULIC CYLINDER

[75] Inventor: Donald K. Spring, Topeka, Kans.

[73] Assignee: Allis-Chalmers Corporation, Milwaukee, Wis.

[21] Appl. No.: 219,997

[22] Filed: Dec. 23, 1980

[51] Int. Cl.[3] ..... F15B 15/22

[52] U.S. Cl. ..... 91/26; 91/406; 91/407

[58] Field of Search ..... 91/407, 406, 408, 26; 92/85 B

[56] References Cited

U.S. PATENT DOCUMENTS

| | | | |
|---|---|---|---|
| 1,971,048 | 8/1934 | Parsons | 91/407 |
| 2,114,334 | 4/1938 | Conklin | 91/406 |
| 3,162,092 | 12/1964 | Corwin | 91/407 |
| 3,877,344 | 4/1975 | Langland | 91/407 |
| 3,998,132 | 12/1976 | Rasigade | 91/407 |
| 4,250,793 | 2/1981 | Berg | 91/407 |

*Primary Examiner*—Paul E. Maslousky

*Attorney, Agent, or Firm*—Arthur L. Nelson

[57] ABSTRACT

A cushioning device for decelerating and stopping the piston in a hydraulic cylinder by restricting and throttling the fluid flow from the cylinder.

10 Claims, 2 Drawing Figures

CUSHION STOP FOR HYDRAULIC CYLINDER

This invention relates to a cushioning stop in a hydraulic cylinder and more particularly to a flow restricting means and a throttling means for cushioning the piston at the end of the stroke in a hydraulic cylinder.

As a piston of a hydraulic cylinder reaches the end of its stroke, it must be decelerated to avoid damage from excessive inertia forces. An abrupt stopping of the piston will produce an impact and shock in the hydraulic cylinder, as well as in the mechanism operated by the hydraulic cylinder. Deceleration of the piston may be caused by a spring or a seat which absorbs the energy from the moving piston. The dissipation of energy may also be absorbed by restricting the flow rate while throttling of the hydraulic fluid as the fluid is discharged from the cylinder. This means of cushioning is shown in the Langland U.S. Pat. No. 3,877,344. The fluid flow is restricted by the use of a plunger and a check valve to cushion the piston as it comes to the end of its stroke. By redesigning a cusion device of this type, the manufacturing operations of the plunger are greatly simplified in the applicant's invention. The flow rate is gradually reduced to retard the movement of the piston. The flow control assembly is removable for servicing to assure improved operation and a more reliable operation if the servicing is convenient.

It is an object of this invention to provide a cushioning device for cushioning movement of the piston in a hydraulic cylinder at the end of its stroke.

It is another object of this invention to provide a cushioning device with a plunger operated by the piston in the hydraulic cylinder at the end of its stroke to decrease the flow rate and throttle the hydraulic fluid at the end of its stroke.

It is a further object of this invention to provide a cushioning device for decelerating movement of the piston at the end of its stroke with a plunger biased by a spring which engages the piston selectively restricting flow from the hydraulic cylinder. The exhaust is by engagement of the piston with the plunger to decrease the area of flow from the expansible chamber to the exhaust port.

The objects of the invention are accomplished in a hydraulic cylinder by a spring-biased plunger having radial openings and an orifice which are selectively covered as the plunger is pressed into the housing. This selectively decreases the area of flow from the hydraulic cylinder as the piston nears the end of its stroke. The plunger is axially aligned with the piston and extends from an end cap as the piston engages the plunger. Movement of the piston forces the plunger into the housing and selectively closes orifices on the surface of the plunger to gradially decrease the flow rate and produce throttling in the plunger for cushioning the hydraulic piston at the end of its stroke.

Figure 1:
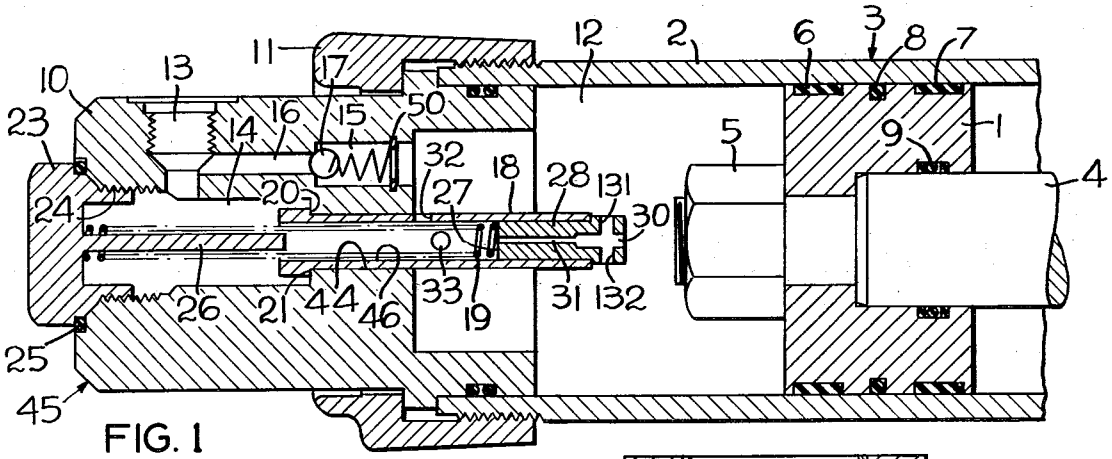
Figure 2:
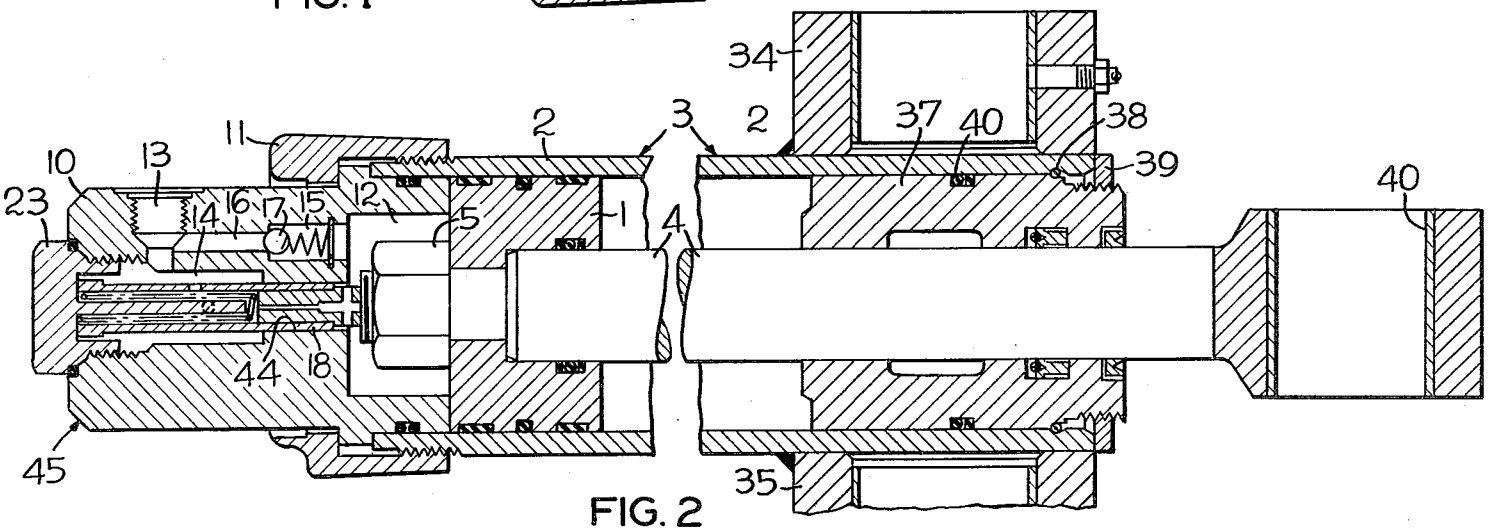

FIG. 1 is a cross-section view of the piston and cylinder and the cushioning device with the device shown before the piston engages the cushioning device; and FIG. 2 is a cross-section view of the hydraulic cylinder showing the cushioning device in the actuated position.

Referring to the drawings, FIG. 1 shows a piston 1 in the sleeve 2 of the hydraulic cylinder 3. The piston 1 includes a rod 4 fastened in the piston by the nut 5. Seals 6, 7 and 8 are formed on the periphery of the piston and engage the inner periphery of sleeve 2. Seal 9 engages the outer periphery of rod 4 as shown.

End cap 10 is fastened by sleeve nut 11 to form expansible chamber 12 within the hydraulic cylinder forward of piston 1. Cap 10 defines a port 13 extending radially into plunger chamber 14. Check valve chamber 15 is also formed in cap 10 and is located between passage 16 and expansible chamber 12. Check valve 17 restricts flow of hydraulic fluid from port 13 to expansible chamber 12 and blocks flow of hydraulic fluid from the expansible chamber to port 13. The plunger chamber 14 receives plunger 18 which is biased inwardly by the spring 19. Shoulders 20 on the outer periphery of plunger 18 engage abutment surface 21 in the extended position. Screw 23 threadedly engages end opening 24 and is sealed by seal 25. Stem 26 extends centrally within the return spring 19 and forms a spring seat on the outer end. The inner end of the spring 19 sits on the radial flange 27 of the insert 28 which is brazed in its position shown. The insert 28 is formed with a central opening 30 which tapers down to an orifice 31 on the inner end. Central opening 30 is in communication with radial openings 131 and 132, as shown.

Similarly, plunger 18 is formed with radial openings 32 and 33 to allow fluid to flow into plunger chamber 14 in the normal operating position.

Sleeve 2 of hydraulic cylinder 3 carries trunnion mounts 34, 35 for supporting of the hydraulic cylinder. Trunnion mounts 34, 35 are fabricated to sleeve 2 and carry the cylinder. The end wall 37 is fastened within the end of sleeve 2 by snap ring 38 and nut 39. Seal 40 provides a seal between the end wall and the sleeve. Piston rod 4 extends from the end wall and forms a bearing 40 for receiving a mating (bearing) element of the driven mechanism. The piston reciprocates within the sleeve and is cushioned in its contracted position as shown in FIG. 2. The piston and cushioning device operates in the following described manner.

Normally the piston moves from the position as shown in FIG. 1 in which the hydraulic fluid is permitted to pass through the radial openings 32 and 33 as well as 131 and 132 and the orifice 31 as the hydraulic fluid escapes through plunger 18 and into plunger chamber 14 and as it exhausts through port 13. As the piston advances, it engages the end of plunger 18 biasing the plunger against spring 19. Plunger 18 is pressed outwardly through central opening 44 in housing 45 of cap 10 and as the plunger continues outwardly, the radial openings 32 and 33 are gradually closed thus restricting flow from chamber 12 because less area is exposed to pressurized fluid. The restriction of the flow tends to slow the movement of the piston toward the end of its stroke. With continued movement of piston 1, hydraulic fluid passes through radial openings 131 and 132 and orifice 31 and passes through central opening 46 in plunger 18. Fluid is exhausted through port 13. Energy is dissipated as the flow into the plunger is restricted and the piston decelerates as it nears the end of its stroke. Since only a limited amount of fluid can pass through orifice 31 when the piston reaches the end of its stroke, it is travelling very slowly and a minimum of shock is encountered as the piston bottoms out and the piston engages cap 10.

When the piston is extended within sleeve 2 of the hydraulic cylinder 3, partial fluid flow is permitted to go through check valve 17 into expansible chamber 12. As the piston is extended, the plunger follows the piston and fluid then begins to flow through ports 33, 32 until the piston disengages from the plunger in which normal flow is permitted.

Cap 10 can be removed from sleeve 2 by removing sleeve nut 11. Plunger 18 can be removed from the assembly by removing cap screw 23 and allowing the plunger to move out of threaded opening 24. With the cap removed from sleeve 2, snap ring 50 can be removed allowing check valve 17 to be removed. Accordingly, the assembly can be easily disassembled for servicing or replacement of any parts. The ease in assembly and disassembly provides for minimum time in servicing and repair.

The embodiments of the invention in which an exclusive property or privilege is claimed are defined as follows:

1. A cushioning device in a hydraulic cylinder comprising, a hydraulic cylinder including a sleeve, a cap removably fastened on the end of said sleeve, a piston reciprocally mounted in said sleeve defining an expansible chamber with said cap, means defining a port in said cap, a check valve in said cap connected between said port and said expansible chamber providing inward flow from said port to said expansible chamber, means defining a plunger chamber connected between said port and said expansible chamber, a plunger received in an opening in said cap and extending into said plunger chamber axially aligned with the reciprocal movement of said piston, resilient means biasing said plunger toward said piston, means defining a central opening in said plunger forming an orifice on an inner end of said plunger communicating with said expansible chamber, radial openings axially spaced along said plunger connected to said central opening selectively closing and restricting fluid flow through said radial openings and limiting flow from said expansible chamber to said port as said plunger is pressed toward said cap as said piston reaches the end of the stroke to thereby provide a cushioning of said piston at the end of its stroke.

2. A cushioning device in a hydraulic cylinder as set forth in claim 1 wherein the outer end of said plunger defines a stop and abutment means engaging said stop in its extended position.

3. A cushioning device in a hydraulic cylinder as set forth in claim 1 including a sleeve nut fastening said cap to said sleeve of said hydraulic cylinder.

4. A cushioning device in a hydraulic cylinder as set forth in claim 1 including a removable cap screw means threadedly engaging a central opening in the end of said cap for removably retaining said plunger in said hydraulic cylinder.

5. A cushioning device in a hydraulic cylinder as set forth in claim 1 wherein said piston and said plunger define coaxially aligned axes.

6. A cushioning device in a hydraulic cylinder as set forth in claim 1 including means defining a cylindrical opening receiving said check valve, a snap ring and spring in said cylindrical opening retaining said check valve in said cylindrical opening.

7. A cushioning device in a hydraulic cylinder as set forth in claim 1 including, means defining a radial positioning of said port in said cap.

8. A cushioning device in a hydraulic cylinder as set forth in claim 1 including means defining a peripheral shoulder on said plunger defining the limits of inner movement of said plunger in said cap.

9. A cushioning device in a hydraulic cylinder as set in claim 1 wherin said resilient means defines a spring extending into the central opening of said plunger to bias said plunger toward said piston.

10. A cushioning device in a hydraulic cylinder as set forth in claim 1 including, means defining at least two of said radial openings to restrict the flow from said expansible chamber to said port as said plunger is pressed into said cap.

* * * * *